US006547640B2

(12) United States Patent
Hofmann

(10) Patent No.: US 6,547,640 B2
(45) **Date of Patent: *Apr. 15, 2003**

(54) DEVICES AND METHODS FOR IN-SITU CONTROL OF MECHANICAL OR CHEMICAL-MECHANICAL PLANARIZATION OF MICROELECTRONIC-DEVICE SUBSTRATE ASSEMBLIES

(75) Inventor: Jim Hofmann, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/935,067

(22) Filed: Aug. 21, 2001

(65) Prior Publication Data

US 2002/0119731 A1 Aug. 29, 2002

Related U.S. Application Data

(63) Continuation of application No. 09/534,248, filed on Mar. 23, 2000, now Pat. No. 6,290,572.

(51) Int. Cl.[7] ..... B24B 49/00

(52) U.S. Cl. ..... 451/5; 451/6; 451/41; 451/287; 451/307

(58) Field of Search ..... 451/5, 6, 41, 63, 451/89, 285–288, 296, 299, 307

(56) References Cited

U.S. PATENT DOCUMENTS

| | | | |
|---|---|---|---|
| 4,200,395 | A | 4/1980 | Smith et al. |
| 4,203,799 | A | 5/1980 | Sugawara et al. |
| 4,358,338 | A | 11/1982 | Downey et al. |
| 4,367,044 | A | 1/1983 | Booth, Jr. et al. |

(List continued on next page.)

OTHER PUBLICATIONS

Tyrone L. Vencent, Pramod P. Khargonekar and Fred L. Terry, Jr., "An extended Kalman Filtering–Based Method of Processing Reflectometry Data for Fast In–Situ Etch Rate Measurements", IEEE Transactions on Semiconductor Manufacturing: vol. 10, No. 1, Feb. 1997.

(List continued on next page.)

*Primary Examiner*—Joseph J. Hail, III
*Assistant Examiner*—David B. Thomas
(74) *Attorney, Agent, or Firm*—Perkins Coie LLP

(57) ABSTRACT

Planarizing machines and methods for endpointing or otherwise controlling mechanical and/or chemical-mechanical planarization of microelectronic-device substrates. In one embodiment of the invention, a method for planarizing a microelectronic substrate assembly includes removing material from the substrate assembly during a planarizing cycle by contacting the substrate assembly with a planarizing medium and moving the substrate assembly and/or the planarizing medium relative to each other. The method can also include controlling the planarizing cycle by predicting a thickness of an outer film over a first region on the substrate assembly and providing an estimate of an erosion rate ratio between the first region and a second region. The endpointing procedure continues by determining an estimated value of an output factor, such as a reflectance intensity from the substrate assembly, by modeling the output factor based upon the thickness of the outer film over the first region and the erosion rate ratio between the first region and the second region. The endpointing procedure continues by ascertaining an updated predicted thickness of the outer film over the first region by measuring an actual value of the output factor during the planarizing cycle without interrupting removal of material from the substrate, and then updating the predicted thickness of the outer film according to the actual value of the output factor and the estimated value of the output factor. The updated predicted thickness can be determined using an Extended Kalman Filter. The planarizing process is controlled according to the updated predicted thickness of the outer film.

15 Claims, 9 Drawing Sheets

U.S. PATENT DOCUMENTS

| | | | |
|---|---|---|---|
| 4,377,028 | A | 3/1983 | Imahashi |
| 4,422,764 | A | 12/1983 | Eastman |
| 4,640,002 | A | 2/1987 | Phillips et al. |
| 4,717,255 | A | 1/1988 | Ulbers |
| 5,036,015 | A | 7/1991 | Sandhu et al. |
| 5,069,002 | A | 12/1991 | Sandhu et al. |
| 5,081,796 | A | 1/1992 | Schultz |
| 5,220,405 | A | 6/1993 | Barbee et al. |
| 5,324,381 | A | 6/1994 | Nishiguchi |
| 5,337,144 | A | 8/1994 | Strul et al. |
| 5,369,488 | A | 11/1994 | Morokuma |
| 5,413,941 | A | 5/1995 | Koos et al. |
| 5,433,651 | A | 7/1995 | Lustig et al. |
| 5,461,007 | A | 10/1995 | Kobayashi |
| 5,465,154 | A | 11/1995 | Levy |
| 5,642,303 | A | 6/1997 | Small et al. |
| 5,645,471 | A | 7/1997 | Strecker |
| 5,648,847 | A | 7/1997 | Ebbing |
| 5,658,183 | A | 8/1997 | Sandhu et al. |
| 5,663,797 | A | 9/1997 | Sandhu |
| 5,777,739 | A | 7/1998 | Sandhu et al. |
| 5,809,182 | A | 9/1998 | Ward et al. |
| 5,865,665 | A | 2/1999 | Yueh |
| 5,879,222 | A | 3/1999 | Robinson |
| 5,949,927 | A | 9/1999 | Tang |
| 6,004,187 | A | 12/1999 | Nyui et al. |
| 6,024,628 | A | 2/2000 | Chen |
| 6,042,454 | A | 3/2000 | Watanabe |
| 6,045,439 | A | 4/2000 | Birang et al. |
| 6,074,517 | A | 6/2000 | Taravade |
| 6,075,606 | A | 6/2000 | Doan |
| 6,135,859 | A | 10/2000 | Tietz |
| 6,146,242 | A | 11/2000 | Treur et al. |
| 5,159,075 | A | 12/2000 | Zhang |
| 6,159,073 | A | 12/2000 | Wiswesser et al. |
| 6,179,688 | B1 | 1/2001 | Beckage et al. |
| 6,190,234 | B1 | 2/2001 | Swedek et al. |
| 6,290,572 | B1 | 9/2001 | Hofmann |

OTHER PUBLICATIONS

Tyrone L. Vencent, Pramod P. Khargonekar and Fred L. Terry, Jr., "End Point and Etch Rate Control Using Dual–Wavelength Laser Reflectometry with a Nonlinear Estimator", The Electrochemical Society, Inc., J. Electrochem. Soc. vol. 144, N 1997.

T.L. Vincent, P.P. Khargonekar and F.L. Terry, Jr., "An Extended Kalman Filter Based Method for Fast In–Situ Etch Rate Measurement", Mat. Res. Symp. Proc. vol. 406, 1996 Materials Research Society.

DEVICES AND METHODS FOR IN-SITU CONTROL OF MECHANICAL OR CHEMICAL-MECHANICAL PLANARIZATION OF MICROELECTRONIC-DEVICE SUBSTRATE ASSEMBLIES

This is a continuation of application Ser. No. 09/534,248, filed Mar. 23, 2000, now U.S. Pat. No. 6,290,572.

TECHNICAL FIELD

The present invention relates to devices and methods for estimating selected parameters for controlling mechanical and/or chemical-mechanical planarization of microelectronic-device substrate assemblies. More particularly, the present invention relates to in-situ optical endpointing methods and devices.

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic device substrate assemblies. CMP processes generally remove material from a substrate assembly to create a highly planar surface at a precise elevation in the layers of material on the substrate assembly. FIG. 1 schematically illustrates an existing web-format planarizing machine 10 for planarizing a substrate 12. The planarizing machine 10 has a support table 14 with a top-panel 16 at a workstation where an operative portion (A) of a planarizing pad 40 is positioned. The top-panel 16 is generally a rigid plate to provide a flat, solid surface to which a particular section of the planarizing pad 40 may be secured during planarization.

The planarizing machine 10 also has a plurality of rollers to guide, position and hold the planarizing pad 40 over the top-panel 16. The rollers include a supply roller 20, idler rollers 21, guide rollers 22, and a take-up roller 23. The supply roller 20 carries an unused or pre-operative portion of the planarizing pad 40, and the take-up roller 23 carries a used or post-operative portion of the planarizing pad 40. Additionally, the left idler roller 21 and the upper guide roller 22 stretch the planarizing pad 40 over the top-panel 16 to hold the planarizing pad 40 stationary during operation. A motor (not shown) generally drives the take-up roller 23 to sequentially advance the planarizing pad 40 across the top-panel 16, and the motor can also drive the supply roller 20. Accordingly, clean pre-operative sections of the planarizing pad 40 may be quickly substituted for used sections to provide a consistent surface for planarizing and/or cleaning the substrate 12.

The web-format planarizing machine 10 also has a carrier assembly 30 that controls and protects the substrate 12 during planarization. The carrier assembly 30 generally has a substrate holder 32 to pick up, hold and release the substrate 12 at appropriate stages of the planarizing process. Several nozzles 33 attached to the substrate holder 32 dispense a planarizing solution 44 onto a planarizing surface 42 of the planarizing pad 40. The carrier assembly 30 also generally has a support gantry 34 carrying a drive assembly 35 that can translate along the gantry 34. The drive assembly 35 generally has an actuator 36, a drive shaft 37 coupled to the actuator 36, and an arm 38 projecting from the drive shaft 37. The arm 38 carries the substrate holder 32 via a terminal shaft 39 such that the drive assembly 35 orbits the substrate holder 32 about an axis B—B (arrow $R_1$). The terminal shaft 39 may also rotate the substrate holder 32 about its central axis C—C (arrow $R_2$).

The planarizing pad 40 and the planarizing solution 44 define a planarizing medium that mechanically and/or chemically-mechanically removes material from the surface of the substrate 12. The planarizing pad 40 used in the web-format planarizing machine 10 is typically a fixed-abrasive planarizing pad in which abrasive particles are fixedly bonded to a suspension material. In fixed-abrasive applications; the planarizing solution is a "clean solution" without abrasive particles. In other applications, the planarizing pad 40 may be a non-abrasive pad that is composed of a polymeric material (e.g., polyurethane) or other suitable materials. The planarizing solutions 44 used with the non-abrasive planarizing pads are typically CMP slurries with abrasive particles and chemicals.

To planarize the substrate 12 with the planarizing machine 10, the carrier assembly 30 presses the substrate 12 against the planarizing surface 42 of the planarizing pad 40 in the presence of the planarizing solution 44. The drive assembly 35 then translates the substrate 12 across the planarizing surface 42 by orbiting the substrate holder 32 about the axis B—B and/or rotating the substrate holder 32 about the axis C—C. As a result, the abrasive particles and/or the chemicals in the planarizing medium remove material from the surface of the substrate 12.

The CMP processes should consistently and accurately produce a uniformly planar surface on the substrate to enable precise fabrication of circuits and photo-patterns. During the fabrication of transistors, contacts, interconnects and other features, many substrates develop large "step heights" that create highly topographic surfaces across the substrates. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing the microelectronic devices.

In the highly competitive semiconductor industry, it is also desirable to a maximize the throughput of CMP processing by producing a planar surface on a substrate as quickly as possible. The throughput of CMP processing is a function, at least in part, of the ability to accurately stop CMP processing at a desired endpoint. In a typical CMP process, the desired endpoint is reached when the surface of the substrate is planar and/or when enough material has been removed from the substrate to form discrete components an on the substrate (e.g., shallow trench isolation areas, contacts, damascene lines, etc.). Accurately stopping CMP processing at a desired endpoint is important for maintaining a high throughput because the substrate assembly may need to be re-polished if it is "under-planarized," or components on the substrate may be destroyed if it is "over-polished."Thus, it is highly desirable to stop CMP processing at the desired endpoint.

In one conventional method for determining the endpoint of CMP processing, the planarizing period of a particular substrate is estimated using an estimated polishing rate based upon the polishing rate of identical substrates that were planarized under the same conditions. The estimated planarizing period for a particular substrate, however, may not be accurate because the polishing rate and other variables may change from one substrate to another. Thus, this method may not produce accurate results.

In another method for determining the endpoint of CMP processing, the substrate is removed from the pad and then a measuring device measures a change in thickness of the substrate. Removing the substrate from the pad, however, interrupts the planarizing process and may damage the substrate. Thus, this method generally reduces the throughput of CMP processing.

U.S. Pat. No. 5,433,651 issued to Lustig et al. ("Lustig") discloses an in-situ chemical-mechanical polishing machine for monitoring the polishing process during a planarizing cycle. The polishing machine has a rotatable polishing table including a window embedded in the table. A polishing pad is attached to the table, and the pad has an aperture aligned with the window embedded in the table. The window is positioned at a location over which the workpiece can pass for in-situ viewing of a polishing surface of the workpiece from beneath the polishing table. The planarizing machine also includes a device for measuring a reflectance signal representative of an in-situ reflectance of the polishing surface of the workpiece. Lustig discloses terminating a planarizing cycle at the interface between two layers based on the different reflectances of the materials. In many CMP applications, however, the desired endpoint is not at an interface between layers of materials. Thus, the system disclosed in Lustig may not provide accurate results in certain CMP applications.

Another endpointing system disclosed in U.S. Pat. No. 5,865,665 issued to Yueh ("Yueh") determines the end point in a CMP process by predicting the removal rate using a Kalman filtering algorithm based on input from a plurality of line Variable Displacement Transducers ("LVDT") attached to the carrier head. The process in Yueh uses measurements of the downforce to update and refine the prediction of the removal rate calculated by the Kalman filter. This downforce, however, varies across the substrate because the pressure exerted against the substrate is a combination of the force applied by the carrier head and the topography of both the pad surface and the substrate. Moreover, many CMP applications intentionally vary the downforce during the planarizing cycle across the entire substrate, or only in discrete areas of the substrate. The method disclosed in Yueh, therefore, may be difficult to apply in some CMP application because it uses the downforce as an output factor for operating the Kalman filter.

SUMMARY OF THE INVENTION

The present invention is directed toward planarizing machines and methods for endpointing or otherwise controlling mechanical and/or chemical-mechanical planarization of microelectronic-device substrates. In one aspect of the invention, a method for planarizing a microelectronic substrate assembly includes removing material from the substrate assembly during a planarizing cycle by contacting the substrate assembly with a planarizing medium and moving the substrate assembly and/or the planarizing medium relative to each other. The method can control a process parameter of a planarizing cycle, such as endpointing the planarizing cycle or determining the status of the surface of the substrate. For example, the method can endpoint the planarizing cycle by predicting a thickness of an outer film over a first region on the substrate assembly and providing an estimate of an erosion rate relationship based on a first erosion rate over the first region and a second erosion rate over a second region. The erosion rate relationship can be the first and second erosion rates or an erosion rate ratio between the first and second erosion rates. The first region can be an array at a first elevation and the second region can be a periphery area at a second elevation.

The endpointing procedure continues by determining an estimated value of an output factor, such as a reflectance intensity from the substrate assembly. The output factor can be estimated by modeling the output factor based upon the thickness of the outer layer over the first region and the erosion rate ratio between the first region and the second region. The endpointing procedure continues by ascertaining an updated predicted thickness of the outer film over the first region by measuring an actual value of the output factor during the planarizing cycle without interrupting removal of material from the substrate, and then updating the predicted thickness of the outer film according to the variance between the actual value of the output factor and the estimated value of the output factor. The endpointing process also continues by repeating the determining procedure and the ascertaining procedure using the revised predicted thickness of the outer layer of an immediately previous iteration to bring the estimated value of the output factor to within a desired range of the actual value of the output factor. The planarizing process is terminated when the updated predicted thickness of the outer layer over the first region is within a desired range of an endpoint elevation in a substrate assembly.

Several embodiments of methods in accordance with the invention can be performed with a planarizing machine having an endpointing system including a computer having an optical module and a Kalman module. The optical module can be programmed with optical algorithms for modeling a total reflectance from the substrate based upon the proportionate reflectances from the arrays and the periphery areas. The Kalman module can be programmed with an Extended Kalman Filtering ("EKF") algorithm for estimating a number of operating variables ("state variables") of the CMP process based upon the estimated reflectance and the measured reflectance. The Kalman module updates the estimates of the operating variables and the optical module revises the estimate of the reflectance based on the updates of the operating variables until the estimated values of the reflectance converge with the measured values of the reflectance. At this point, the estimated operating variables should approximately equal the actual operating variables. Therefore, when one of the operating variables is the thickness of the outer film over the arrays, the planarizing cycle can be endpointed when the estimated thickness of the outer film is approximately equal to a desired endpoint thickness.

DETAILED DESCRIPTION

The present invention is directed toward planarizing machines and methods for endpointing or otherwise controlling mechanical and/or chemical-mechanical planarization of microelectronic-device substrates. Many specific details of the invention are described below with reference to web-format planarizing applications to provide a thorough understanding of such embodiments. The present invention, however, can be practiced using rotary planarizing machines, such as the Mirra planarizing machine manufactured by Applied Materials Corporation. A person skilled in the art will thus understand that the invention may have additional embodiments, or that the invention may be practiced without several of the details described below.

A. CMP Machines With Optical Control Systems

Figure 2:
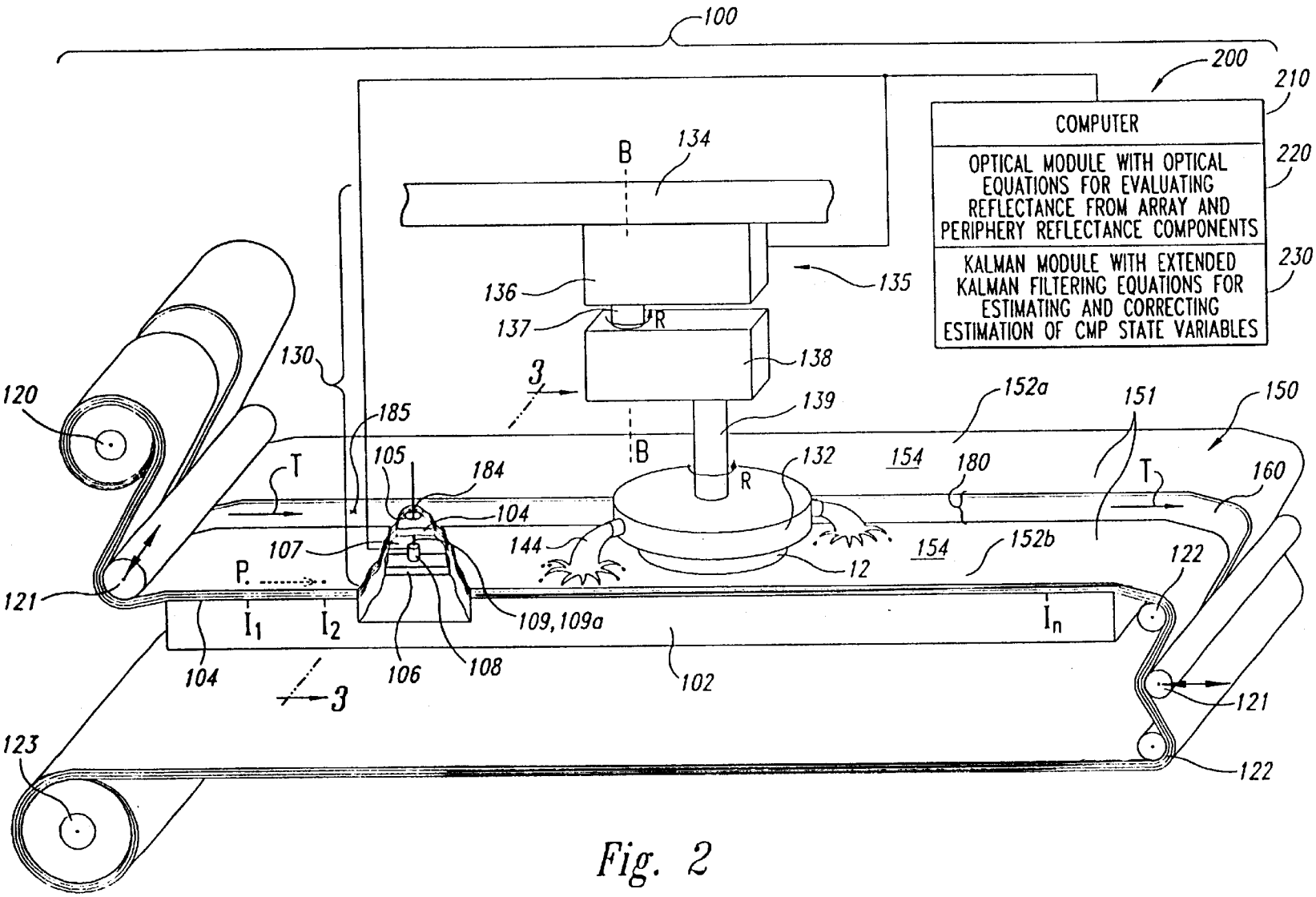
FIG. 2 is a partially schematic isometric view of a planarizing machine having an endpointing system in accordance with one embodiment of the invention.

FIG. 2 is an isometric view of a web-format planarizing machine 100 including an optical reflectance system 107 and an end pointing system 200 in accordance with one embodiment of the invention. The planarizing machine 100 has a table 102 including a stationary support surface 104, an opening 105 at an illumination site in the support surface 104, and a shelf 106 under the support surface 104. The planarizing machine 100 also includes an optical emitter/sensor 108 mounted to the shelf 106 at the illumination site. The optical sensor 108 projects a light beam 109 through the hole 105 and the support surface 104. The optical sensor 108 can be a reflectance device that emits the light beam 109 and senses a reflectance 109*a* to determine the surface condition of a substrate 12 in-situ and in real time. Reflectance and interferometer endpoint sensors that may be suitable for the optical sensor 108 are disclosed in U.S. Pat. Nos. 5,865,665; 5,648,847; 5,337,144; 5,777,739; 5,663,797; 5,465,154; 5,461,007; 5,433,651; 5,413,941; 5,369,488; 5,324,381; 5,220,405; 4,717,255; 4,660,980; 4,640,002; 4,422,764; 4,377,028; 5,081,796; 4,367,044; 4,358,338; 4,203,799; and 4,200,395; and U.S. application Ser. Nos. 09/066,044 and 09/300,358; all of which are herein incorporated by reference.

Figure 1:
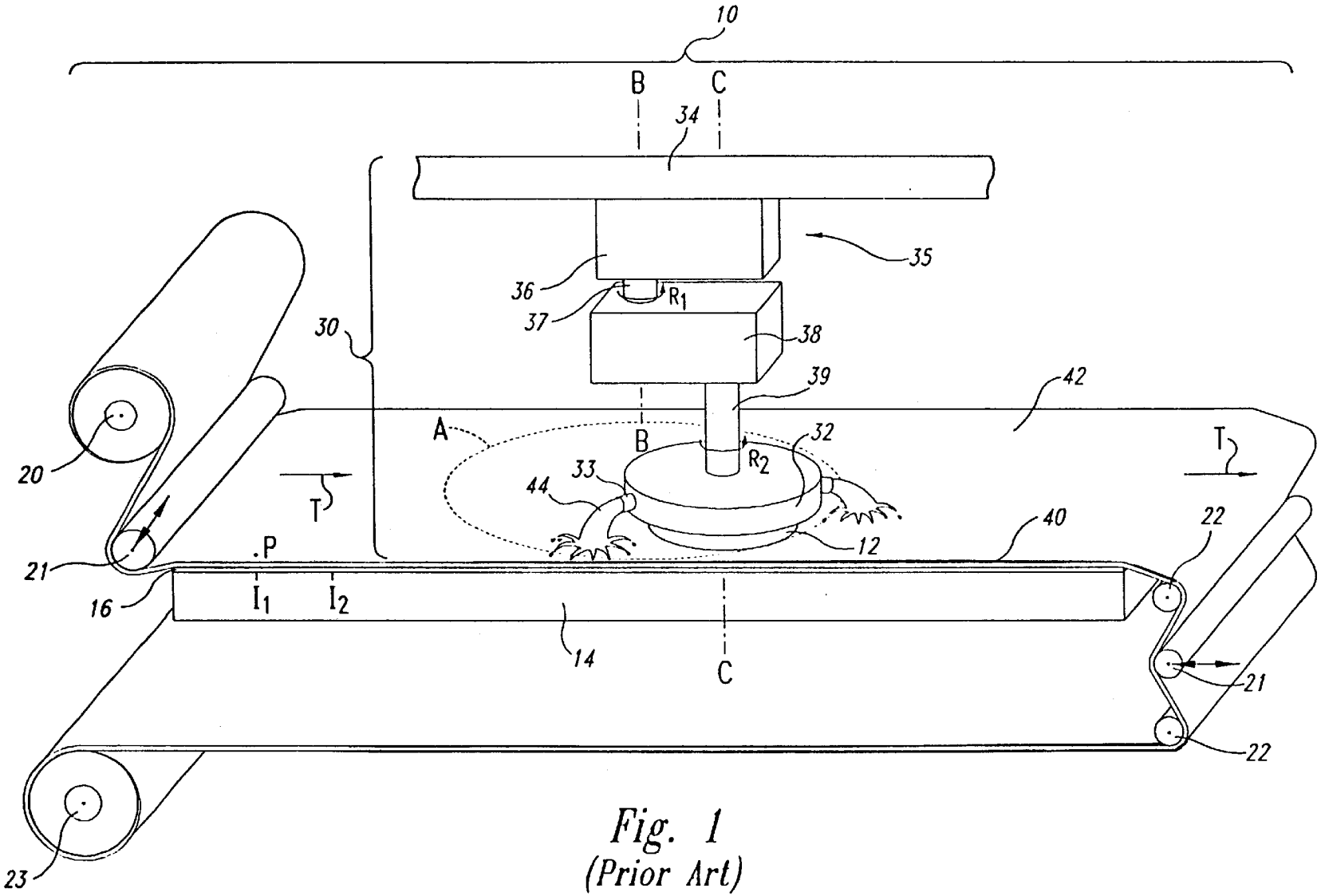
Fig. 1 (Prior Art)
FIG. 1 is a partially schematic isometric view of a web-format planarizing machine in accordance with the prior art.

The planarizing machine 100 can further include a pad advancing mechanism having a plurality of rollers 120, 121, 122 and 123 that are substantially the same as the roller system described above with reference to the planarizing machine 10 in FIG. 1. Additionally, the planarizing machine 100 can include a carrier assembly 130 that is substantially the same as the carrier assembly 30 described above with reference to FIG. 1.

Figure 3:
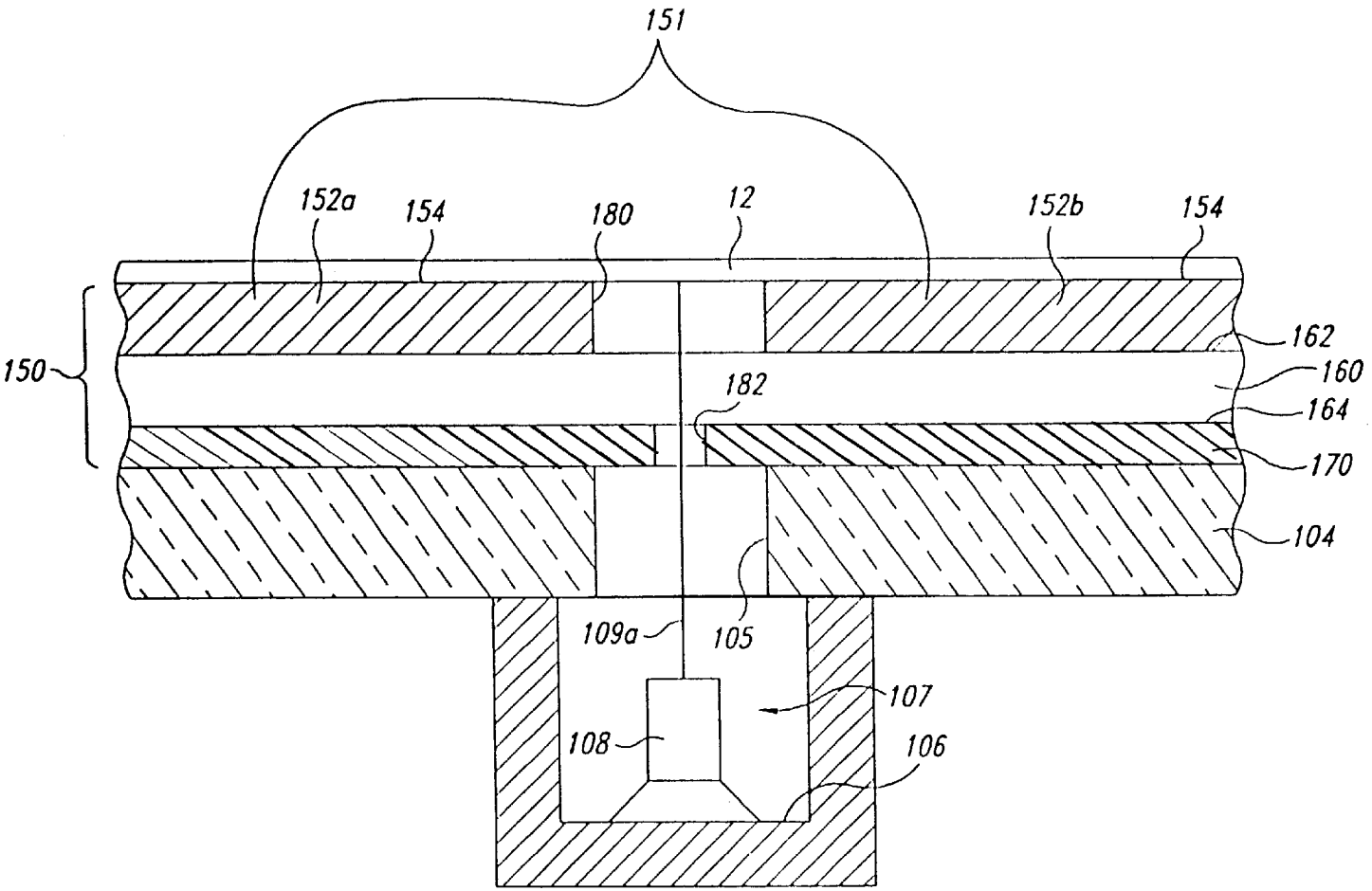
FIG. 3 is a cross-sectional view illustrating a portion of the planarizing machine of FIG. 2 along line 3—3.

FIG. 3 is a cross-sectional view partially illustrating a web format polishing pad 150 on the support surface 104, and the optical sensor 108 in greater detail. Referring to FIGS. 2 and 3 together, the polishing pad 150 has a planarizing medium 151 with a first section 152*a*, a second section 152*b*, and a planarizing surface 154 defined by the upper surfaces of the first and second sections 152*a* and 152*b*. The planarizing medium 151 can be an abrasive or a non-abrasive material. For example, an abrasive planarizing medium 151 can have a resin binder and abrasive particles distributed in the resin binder. Suitable abrasive planarizing mediums 151 are disclosed in U.S. Pat. Nos. 5,645,471; 5,879,222; 5,624,303; and U.S. patent application Ser. Nos. 09/164,916 and 09/001,333, all of which are herein incorporated by reference. In this embodiment, the polishing pad 150 also includes an optically transmissive backing sheet 160 under the planarizing medium 151 and a resilient backing pad 170 under the backing sheet 160. The planarizing medium 151 can be disposed on a top surface 162 of the backing sheet 160, and the backing pad 170 can be attached to an under surface 164 of the backing sheet 160. The backing sheet 160, for example, can be a continuous sheet of polyester (e.g., Mylar®) or polycarbonate (e.g., Lexan®). The backing pad 170 can be a polyurethane or other type of compressible material. In one particular embodiment, the planarizing medium 151 is an abrasive material having abrasive particles, the backing sheet 160 is a long continuous sheet of Mylar, and the backing pad 170 is a compressible polyurethane foam.

The polishing pad 150 also has an optical pass-through system to allow the light beam 109 to pass through the pad 150 and illuminate an area on the bottom face of the substrate 12 irrespective of whether a point P on the pad 150 is at position $I_1$, $I_2$. . . or $I_n$ (FIG. 2). In this embodiment, the optical pass-through system includes a first view port defined by a first elongated slot 180 through the planarizing medium 151 and a second view port defined by a second elongated slot 182 (FIG. 3 only) through the backing pad 170. The first and second elongated slots 180 and 182 can extend along the length of the polishing pad 150 in a direction generally parallel to a pad travel path T—T. The first and second slots 180 and 182 are also aligned with the hole 105 in the support surface 104 so that the light beam 109 and the reflectance 109*a* can pass through any view site along the first and second slots 180 and 182. When the point P is at intermediate location $I_1$, for example, a view site 184 along the first and second elongated slots 180 and 182 is aligned with the hole 105. After the polishing pad 150 has moved along the pad travel path T—T so that the point P is at intermediate position $I_2$, another view site 185 along the first and second elongated slots 180 and 182 is aligned with the hole 105.

The embodiment of the polishing pad 150 shown in FIGS. 2 and 3 allows the optical sensor 108 to detect the reflectance 109*a* from the substrate 12 in-situ and in real time during a planarizing cycle on the web-format planarizing machine 100. In operation, the carrier assembly 130 moves the substrate 12 across the planarizing surface 154 as a planarizing solution 144 flows onto the polishing pad 150. The planarizing solution 144 is generally a clear, non-abrasive solution that does not block the light beam 109 or the reflectance 109*a* from passing through the first elongated slot 180. As the carrier assembly 130 moves the substrate 12, the light beam 109 passes through both the optically transmissive backing sheet 160 and the clean planarizing solution in the first elongated slot 180 to illuminate the face of the substrate 12 (FIG. 3). The reflectance 109*a* returns to the optical sensor 108 through slot 180. The optical sensor 108 thus detects the reflectance 109*a* from the substrate 12 throughout the planarizing cycle.

The planarizing machine 100 also includes an endpointing system 200 (shown schematically) coupled to the optical sensor 108. The endpointing system 200 can include a computer 210 having an optical module 220 and a Kalman module 230. The optical module 220 is programmed with optical algorithms for modeling the total reflectance from the substrate 12 based upon the proportionate reflectances from the arrays and the periphery areas on the substrate 12. The Kalman module 230 is programmed with an Extended Kalman Filtering (EKF) algorithm for estimating a number of state variables of the CMP process based on the measured reflectance 109*a*. A "state variable" is an operating variable of the CMP process related to the status of the surface of the substrate 12 and/or the reflectance 109*a*. As explained below, the Kalman module 230 refines the estimates of the state variables, and then the computer 210 uses the refined estimates of the state variables to estimate the endpoint of the CMP process.

B. Particular State Variables For Endpointing CMP Processing

One aspect of several embodiments of the invention is determining the appropriate state variables for estimating the endpoint of CMP processing. The state variables generally cannot be observed during a planarizing cycle, but at least some of the state variables can be modeled by an algorithm using an output factor of the CMP process. The output factor preferably provides an accurate indication of the status of the substrate, and it should be able to be determined in-situ during a planarizing cycle. One particularly useful output factor is the measured reflectance 109*a* from the substrate assembly, which can be related to certain state variables by optical algorithms programmed in the optical module 220 and the EKF algorithm programmed in the Kalman module 230. Therefore, to provide an accurate estimate of the endpoint or other aspects of a planarizing cycle, one embodiment of the endpointing system 200 is operated by selecting the appropriate state variables for determining the endpoint when the reflectance is the output factor.

Figure 4:
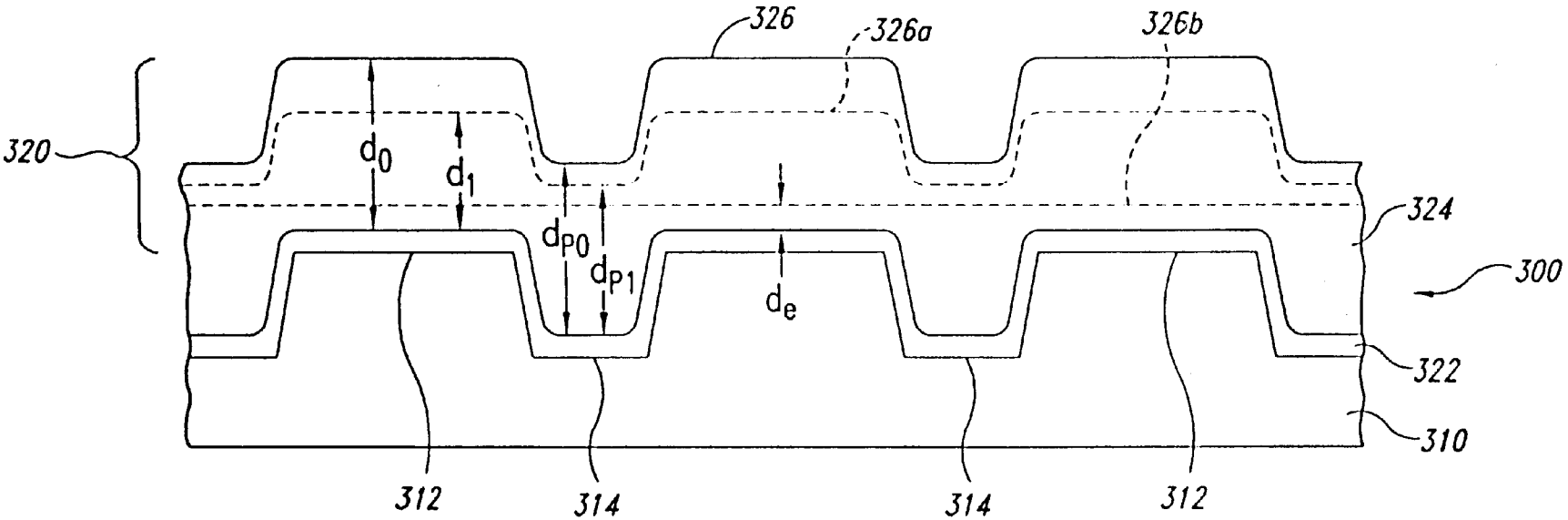
FIG. 4 is a schematic cross-sectional view illustrating a portion of a microelectronic substrate throughout various stages of methods in accordance with the invention.

FIG. 4 is a schematic cross-sectional side view of a portion of a microelectronic-device substrate assembly 300 having a plurality of arrays 312 and a plurality of periphery areas 314 that illustrates several state variables related to the surface of the substrate assembly. The substrate assembly 300 has a film stack 320 with an outer film or top layer 324. The film stack 320 can also have several other configurations with one or more underlying layers 322. Before planarizing the substrate assembly 300, the top layer 324 initially has a thickness (depth) $d_0$ over the arrays 312 and an initial depth $d_{p0}$ over the periphery areas 314. The erosion rate of the top layer 324 is initially much greater over the arrays 312 than over the periphery areas 314 because the planarizing pad exerts more pressure against the arrays 312. As such, the thickness of top layer 324 decreases much faster over the arrays 312 than over the periphery areas 314. The contour of the top surface 326 at an intermediate stage of the planarizing cycle can change to a surface 326*a* (shown in phantom) in which the change in thickness of the top layer 324 over the arrays 312 ($d_0$–$d_1$) is significantly greater than the change in thickness over the periphery areas 314 ($d_{p0}$–$d_{p1}$). At the endpoint of the planarizing cycle, however, the finished surface 326*b* (also shown in phantom) of the top layer 324 is substantially planar such that the erosion rate over the arrays 312 is approximately equal to the erosion rate over the periphery areas 314.

Still referring to FIG. 4, one state variable is the depth or thickness of the top layer 324 over the arrays 312. The CIP process is generally endpointed in the portion of the top layer 324 over the arrays 312 or at the interface between the top layer 324 and the conformal layer 322. The depth of the top later 324 over the arrays 312 at an elapsed time kT during a planarizing cycle is defined by the term d(kT), and the erosion rate over the arrays 312 is defined by the term er(kT). As such, at the next point in time ((k+1)T), the depth d is decreased by Ter(kT) in which the erosion rate er is a negative value. The depth of the top layer 324 over the arrays 312 is accordingly defined by the equation $$d((k+1)T)=d(kT)+Ter(kT).$$

The erosion rate er(kT) of the top layer 324 over the arrays 312 is another state variable because the erosion rate varies during a planarizing cycle and it affects the depth of the top layer 324 over the arrays 312. The erosion rate over the arrays 312 changes as a function of time according to the following equation $$er(kT)=er(kT)+w_{er}(kT)+u(kT).$$

In this equation, $w_{er}$ is a zero mean white Gaussian sequence of the signal noise and u is a known reference signal of the trajectory of the erosion rate. The value of $w_{er}$ varies over the planarizing cycle, and it can be determined by analyzing reflectance data from test planarizing cycles and comparing the reflectance data with the actual measured erosion rates taken ex-situ in the test planarizing cycles to estimate the noise in the signal. Similarly, the variance in u over the planarizing cycle can also be estimated from the trajectory of the erosion rate over the test planarizing cycles. The variables $W_{er}$ and u accordingly incorporate known information about the noise and the expected erosion rate over the planarizing cycle of a particular substrate design. The determination of $w_{er}$ and u are known to a person skilled in the art and can be programmed in data files in the optical module 220 and/or the Kalman module 230 (FIG. 2).

Another state variable for estimating the endpoint of CMP processing in accordance with several embodiments of the invention is the erosion rate ratio ("L") of the periphery erosion rate over the periphery areas 314 and the array erosion rate over the arrays 312. The periphery erosion rate over the periphery areas 314 affects the array erosion rate over the arrays 312 because the array erosion rate generally decreases as the planarizing cycle progresses. Referring again to FIG. 4, the array erosion rate over the arrays 312 is initially greater than the erosion rate over the periphery areas 314, but the erosion rate ratio L approaches 1.0 as the surface of the substrate assembly becomes planar. Depending upon the architecture of the substrate 12, the erosion rate ratio L is generally about 0.3–0.4 at the start of a planarizing cycle. Therefore, the erosion rate ratio L between the array erosion rate and the periphery erosion rate is another state variable that affects endpointing the CMP process.

When the reflectance 109*a* (FIG. 3) of the light beam is the output factor of the CMP process for operating the Kalman module 230, an additional state variable is the gain h of the optical system. During a planarizing cycle, the optical system is also subject to fluctuations that affect the reflectance signal generated by the light sensor 108. The signal generated by the sensor 108, for example, can be affected by the depth and clarity of the planarizing solution 144 over the light beam 109, or the clarity of the optically transmissive sheet 160. The gain h of the light sensor 108 accordingly compensates for changes in these variables. The equation for modeling the optical gain h is as follows:

$$h((k+1)T)=h(KT)+w_h(KT).$$

In this equation, $w_h$ is another Gaussian sequence independent of $w_{er}$. The value of $w_h$ varies over the planarizing cycle, and it can be determined by analyzing reflectance data from test planarizing cycles and comparing the actual reflectance data with a theoretical reflectance signal based upon known optical equations for reflectance from a film stack to estimate the noise in the signal. The determination of $w_h$ is also known to a person skilled in the art and can be programmed as a function time into data files in the optical module 220 and/or the Kalman module 230.

The state variables d, er, L and h cannot be directly measured in-situ during a planarizing cycle, but one aspect of a preferred embodiment is to accurately model the reflectance based on the depth "d" over the arrays. Additionally, the etch rate er can then be determined by the change in the depth over time. Therefore, when the output factor for the Kalman module 230 is the reflectance from the substrate, an aspect of several embodiments of the invention is to provide optical algorithms that accurately correlate the depth of the top layer 324 over the arrays 312 with the reflectance from the substrate.

C. Optical Algorithms

The intensity of the reflectance from a film stack having a flat surface can be modeled by determining a reflectance coefficient r that relates the intensity of the reflected light to the incident light intensity. Simple models to determine the reflectance coefficient r for smooth, thin films are well-known to persons skilled in the art. In a film stack having "n" separate films, the reflection coefficient r is related to the depth of the top layer of the film stack by the equation $$r = \frac{a\ a^*}{c\ c^*}.$$

In the above equation, "a" and "c" are variables that relate the propagation of the light through the separate films to the propagation of the light through air, and a* and c* denote the complex conjugates of a and c, respectively. The values for a and c are determined according to the following matrix equation:

$$\begin{pmatrix} a & c \\ b & d \end{pmatrix} = \begin{pmatrix} 1 & r_1 \\ r_1 & 1 \end{pmatrix} \begin{pmatrix} e^{i\delta_1} & r_2 e^{i\delta_i} \\ r_2 e^{-i\delta_1} & e^{-i\delta_1} \end{pmatrix} \cdots \begin{pmatrix} e^{i\delta_{m-1}} & r_m e^{i\delta_{m-1}} \\ r_m e^{-i\delta_{m-1}} & e^{-i\delta_{m-1}} \end{pmatrix}.$$

In this equation, $r_1 \ldots r_m$ are the reflectance coefficients for each layer in the film stack an δ is the change in thickness of each layer. In CMP applications, only the thickness of the top layer 324 changes, and thus the matrix values of the underlying layers are a constant. The determination of a and c for a planar film stack is well known to a person skilled in the art.

Figure 5:
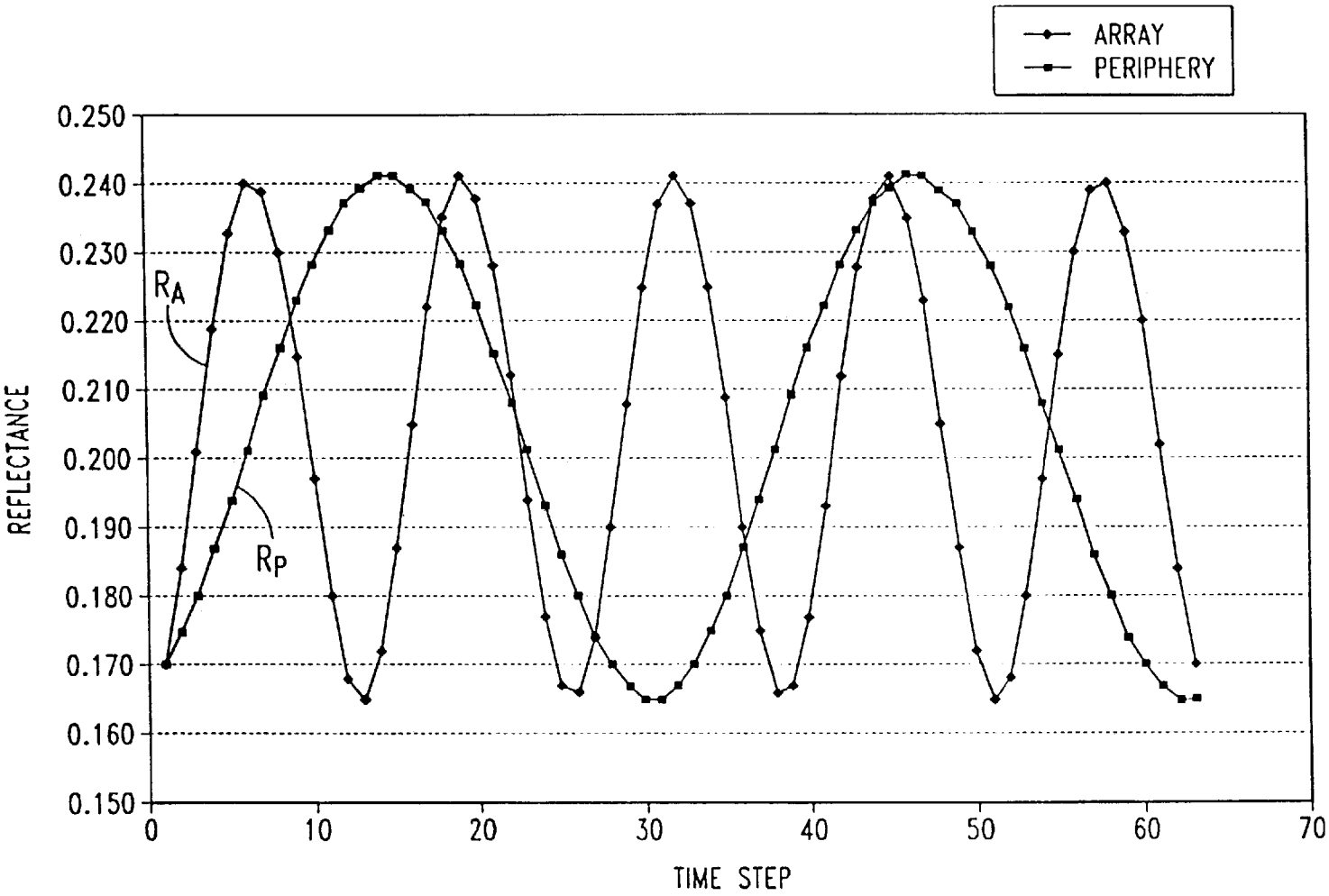
FIG. 5 is a graph illustrating reflectance patterns from arrays and periphery areas on the substrate of FIG. 4.

The reflectance for a planar film stack, however, does not accurately model the reflectance from a topographical substrate having arrays and periphery areas because the reflectance from the arrays varies differently than the reflectance from the periphery areas. FIG. 5, for example, is a graph illustrating the constituent components of the reflectance including the array reflectance ($R_A$) from the arrays 312 (FIG. 4) and the periphery reflectance ($R_p$) from the periphery areas 314 (FIG. 4). The difference in the period of the sinusoidal waveforms for the array reflectance $R_A$ and the periphery reflectance $R_p$ is caused, at least in part, by the difference in the thickness of the top layer over the arrays 312 and the periphery areas 314 that occurs during planarization. Therefore, one aspect of a preferred embodiment of the invention is to provide optical algorithms that model the reflectance based on the proportionate array reflectance and the proportionate periphery reflectance.

The array reflectance $R_A$ at a given depth d of the top layer 324 (FIG. 4) over the arrays 312 is given by the following equation:

$$R_A = \frac{a_A\ a_A^*}{c_A\ c_A^*}.$$

In this equation, $\delta = d_o - d$, $d_o$ is the original thickness of the top layer 324, and d is an estimate of the current thickness. The periphery reflectance $R_p$ at the same moment is given by the following equation:

$$R_P = \frac{a_P\ a_P^*}{c_P\ c_P^*}.$$

In this equation, $\delta = d_o - L\cdot(d_o - d)$, and L is the erosion rate ratio of the periphery erosion rate over the array erosion rate. Thus, by estimating the depth d of the top layer 324 over the arrays 312, both the array and periphery reflectances can be estimated.

The total reflectance r at any given point in time is the sum of a proportionate value of the array reflectance $R_A$ and a proportionate value of the periphery reflectance $R_p$. The array reflectance $R_A$ generally dominates the periphery reflectance $R_p$ because the arrays 312 occupy more surface area of the substrate assembly 300 in a typical application (e.g., approximately 75%). The periphery reflectance $R_p$ accordingly modulates the array reflectance $R_A$ to produce a generally sinusoidal wave for the total reflectance r.

To address the different reflectances from the arrays and the periphery areas, a preferred embodiment of an optical algorithm correlates the array reflectance $R_A$, the periphery reflectance $R_p$, and the relative surface area ("v") covered by the arrays 312 and the periphery areas 314 as a function of the thickness of the top layer 324 over the arrays 312. The optical algorithms determine the individual reflectances from both the arrays 312 and the periphery areas 314 at both a current thickness d and a subsequent thickness d-i of the top layer. The increment "i" for the subsequent thickness can be selected so that it provides good resolution. The increment "i," for example, is generally 5–20 Å. For the increment i=5 Å, the total present reflectance r and the instantaneous slope of the change in reflectance relative to the change in the thickness of the top layer ĉr/ĉd, are as follows:

$$r = v\cdot R_A + (1-v)\cdot R_p$$

$$\partial r / \partial d = \frac{R_{A_d} - [v\cdot R_{A(d-5)} + (1-v)R_{P(d-5)}]}{5}.$$

Based on these equations for estimating the total reflectance r and the change of the reflectance with depth ĉr/ĉd, the EKF algorithm programmed in the Kalman module 230 can provide a control procedure that iteratively estimates the state variables based upon an estimated total reflectance and a measured actual reflectance from the substrate assembly. As explained below, the estimates of the state variables are used to estimate the endpoint and other aspects of CMP processing.

Figure 6:
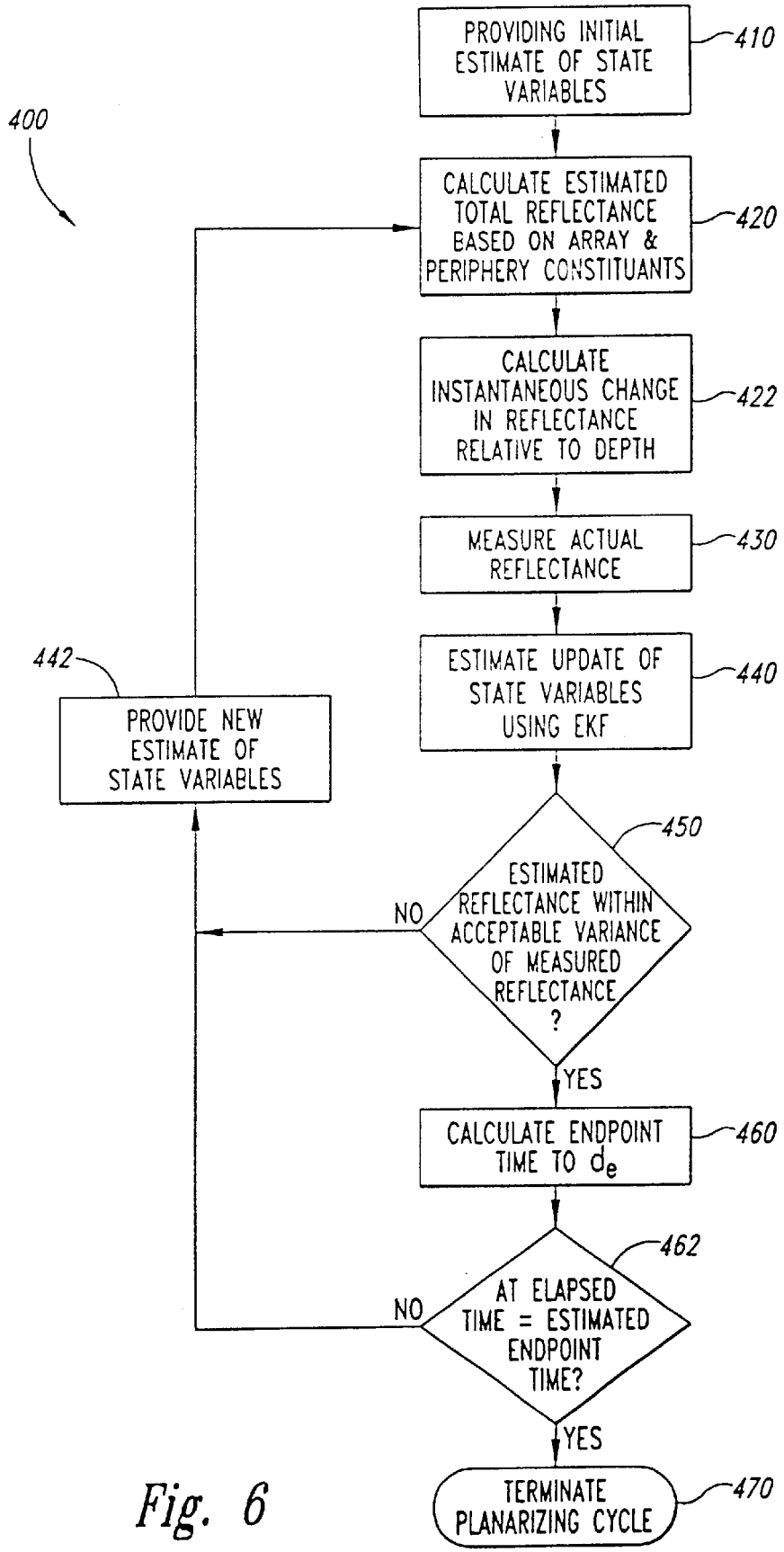
FIG. 6 is a flowchart of a method in accordance with one embodiment of the invention.

D. End Pointing CMP Processing Using the Estimates of the State Variables Based on the Array/Periphery Reflectance Algorithms and an Extended Kalman Filtering Algorithm FIG. 6 is a flowchart of a method 400 for estimating the endpoint of a CMP cycle using the state variables and the array/periphery optical algorithms described above in sections B and C. The first series of routines 410–440 estimates the state variables of the planarizing cycle, and the second series of the routines 450–470 estimates the endpoint of the planarizing cycle based upon the estimates of the state variables. As explained above with respect to FIG. 2, the computer 210 calculates the estimates of the state variables using the signals from the optical sensor 108 along with the algorithms and data files programmed in the optical module 220 and the Kalman module 230.

The embodiment of the endpointing process shown in FIG. 6 begins with a start routine 410 that includes providing an initial estimate of the state variables related to the endpoint of the planarizing cycle. The state variables for this embodiment can include the following: (a) the depth or thickness d of the top layer 324 over the arrays 312 (FIG. 4); (b) the etch rate er of the top layer 324 over the arrays 312; (c) the gain h of the optical reflectance system; and (d) the erosion rate ratio L between the array erosion rate and the periphery erosion rate. As explained below, the state variable can also include other parameters of the planarizing cycle. The initial estimates of the state variables for the start routine 410 can be obtained using data from previous runs of identical substrates or from actual measurements from runs of test substrates. The state variables are specific to the particular architecture of a substrate, and thus the initial estimates of the state variables must be determined for each CMP process of a particular substrate architecture. For the purposes of using the EKF algorithm for this embodiment of the invention, the state variables are mathematically represented by the following column vector.

$$x = \begin{vmatrix} d \\ er \\ h \\ L \end{vmatrix}$$

The embodiment of the endpointing process shown in FIG. 6 continues with a reflectance estimating routine 420 including calculating an estimated total reflectance based upon the estimated depth of the top layer 324 above the arrays 312 provided in the start routine 410. The reflectance routine 420 is preferably performed by the computer 210 and the optical module 220 using the optical algorithm for r set forth above based upon both the proportional array reflectance and the proportional periphery reflectance. The software for performing the total reflectance routine 420 using the computer 210 and the optical module 220 can be developed by a person skilled in the art.

The process continues with a change of reflectance routine 422 including calculating an instantaneous change in reflectance relative to the depth of the top layer. The computer 210 and the optical module 220 preferably perform the change in reflectance routine 422 based on the optical algorithm for ĉr/ĉd, set forth above. The software for performing the change in reflectance routine 422 can also be programmed in computer 210 and the optical module 220 by a person skilled in the art.

After performing the total reflectance routine 420 and the change in reflectance routine 422, the process continues with a measuring routine 430 including measuring the actual reflectance output of the reflectance 109*a* (FIG. 2) using the optical sensor 108. The measured reflectance 109*a* inherently has the proportionate array reflectance from the arrays 312 (FIG. 4) and the proportionate periphery reflectance from the periphery areas 314 (FIG. 4). The optical sensor 108 generates a signal corresponding to the actual total reflectance and sends the signal to the computer 210.

The embodiment of the method shown in FIG. 6 continues with an Extended Kalman Filtering (EKF) routine 440 for refining the estimates of the state variables in the state vector x. The EKF routine 440 involves determining a Kalman gain matrix K, a conditional covariance matrix P, and correlating the equations for the state variables d, er, h and L. When the dynamic equations for the state variables are combined with the optical output, the equations for the update of the state variables x((k−1)1 T) and the measured output of the reflectance y(kt) are as follows:

$$x((k+1)T) = \begin{bmatrix} 1 & T & 0 \\ 0 & 1 & 0 \\ 0 & 0 & I \end{bmatrix} x(kT) + \begin{bmatrix} 0 & 0 \\ 1 & 0 \\ 0 & I \end{bmatrix} w(kT) + \begin{bmatrix} 0 \\ 1 \\ 0 \end{bmatrix} u(kT) \text{ where}$$

$$x(kT) = \begin{bmatrix} d(kT) \\ er(kT) \\ h(kT) \\ L(kT) \end{bmatrix} \text{ and } w(kT) = \begin{bmatrix} w_{er}(kT) \\ w_h(kT) \end{bmatrix}$$

The EKF update equations are given below. In this description, y is the measured reflectance, ŷ is the estimated reflectance based upon the total reflectance routine 420 and the change in reflectance routine 422, and x̂ is a refined estimate of the state variables according to the difference between the measured reflectance y and the estimated reflectance ŷ. The EKF routine performs a measurement update after a new measurement has been acquired, and calculates a time update to determine the new mean and covariance between measurements. Variables with a super-minus (e.g., $\hat{x}^-$) are results of the time update, and the absence of a super-minus indicates the result is from the measurement update.

The equations for the measurement update are as follows.

$$K(kT)=P(kT)^- C_k^T(C_k P(kT)^- C_k^T+R_k)^{-1}$$

$$\hat{y}(kT)=g(\hat{x}(kT)^-, u(kT),0,kT)$$

$$P(kT)=(I-K(kT)C_k)P(kT)^-$$

$$\hat{x}=\hat{x}(kT)^-+K(kT)\ (y(kT)-\hat{y}(kT))$$

The time update is set forth by the following equations.

$$\hat{x}((k+1)T)^-=f(\hat{x}(kT),u(kT),0,kt)$$

$$P((k+1)T)^-=A_k P(kT) A_k^T+Q_k$$

and $$A_k = \left.\frac{\partial f}{\partial x}\right|_{x=\hat{x}(kT)} \quad B_k = \left.\frac{\partial f}{\partial x}\right|_{x=\hat{x}(kT)}$$

$$C_k = \left.\frac{\partial g}{\partial x}\right|_{x=\hat{x}(kT)} \quad D_k = \left.\frac{\partial g}{\partial n}\right|_{x=\hat{x}(kT)}$$

based upon the equations for r and ĉr/ĉd described above, these values are set forth below.

$$A_k = \begin{bmatrix} 1 & \Delta T & 0 \\ 0 & 1 & 0 \\ 0 & 0 & I \end{bmatrix}$$

-continued $$B_k = \begin{bmatrix} 0 & 0 \\ 1 & 0 \\ 0 & I \end{bmatrix}$$

$$C_k = \left[ \frac{\partial r}{\partial d}(\hat{d}(kT)) \quad 0 \quad r(\hat{d}(kT)) \right]$$

$$D_k = I$$

The components of $C_k$ (e.g., the total estimated reflectance r and instantaneous change in reflectance ĉr/ĉd need to be computed for each value of d that will be encountered during the estimation. It is generally sufficient to compute $r_{(d)}$ once at each time step, and then use this and a past value for a slightly different d to approximate ĉr/ĉd as a first difference. Thus, one aspect of this embodiment of the method 400 is that optical algorithms account for the reflectances from the arrays and the periphery areas on a topographical substrate.

The EKF algorithm programmed in the Kalman module 230 and the computer 210 refine the estimates of the state variable from a present estimate x(kT) to the next time increment x((k+1)T) based upon the measured reflectance y and the estimated reflectance ŷ. The basic equations for the EKF are known to persons skilled in the art and have been applied to endpoint and etch rate control of planar film stacks on substrates as set forth in the following references, all of which are herein incorporated by reference: Vincent et al., *End Point and Etch Rate Control Using Dual-Wavelength Laser with a Nonlinear Estimator*, J. ELECTROCHEMICAL SOC'Y, v. 144 (1997); Vincent et al., *An Extended Kalman Filtering-Based Method of Processing Reflectometry Data for Fast In-Situ Etch Rate Measurements*, IEEE TRANSACTIONS ON SEMICONDUCTOR MANUFACTURING, v. 10, No. 1, (February, 1997); Vincent et al., *An Extended Kalman Filler Based Method for Fast In-Situ Etch Rate Measurements*, MAT. RES. SOC. SYS. PROC., Vol. 406, 1996. As such, the Extended Kalman Filtering routine 440 and the databases for operating the routine can be programmed into the computer 210 and the Kalman module 230 by a person skilled in the art.

After the estimates of state variables in the state vector x have been refined for the next iteration x((k+1)T) using the Kalman routine 440, the process continues with a comparing routine 450 in which the estimated reflectance based upon the previous estimate of the state variables is compared with the actual reflectance to determine whether the estimated reflectance is within an acceptable variance. If the estimated reflectance is not within an acceptable variance, the process continues with a repeating routine 442 in which the routines 420–450 are repeated with the refined estimates of the state variables x((k+1)T) from the Kalman routine 440.

The refined estimates of the state variables in the state vector x((k+1)T) from the Kalman routine 440 should cause the value of the estimated reflectance from the total reflectance routine 420 to approximate the measured reflectance. The EKF routine 440 has a high sampling rate and performs several iterations of estimating the state variables to refine the estimates of the state variables before the actual state variables change. The estimated reflectance r from the total reflectance routine 420 accordingly converges with the measured reflectance and then tracks the measured reflectance throughout the planarizing cycle.

When the estimated reflectance is within an acceptable variance of the measured reflectance at the comparing routine 450, the process continues with an endpoint routine 460 in which the time remaining in the planarizing cycle to reach the desired endpoint $d_e$ is calculated using the most recent estimates of the depth d and erosion rate er from the Kalman routine 440. The process then continues with a time routine 462 in which the elapsed time is compared to the estimated time to the endpoint. Before the elapsed time equals the estimated endpoint time, the process continues by repeating the routines 420–462. Once the elapsed time equals the estimated endpoint time, the depth d of the top layer 324 over the arrays 312 should be at the endpoint depth. The process then proceeds to a terminating routine 470 in which the substrate is removed from the planarizing pad.

Figure 7:
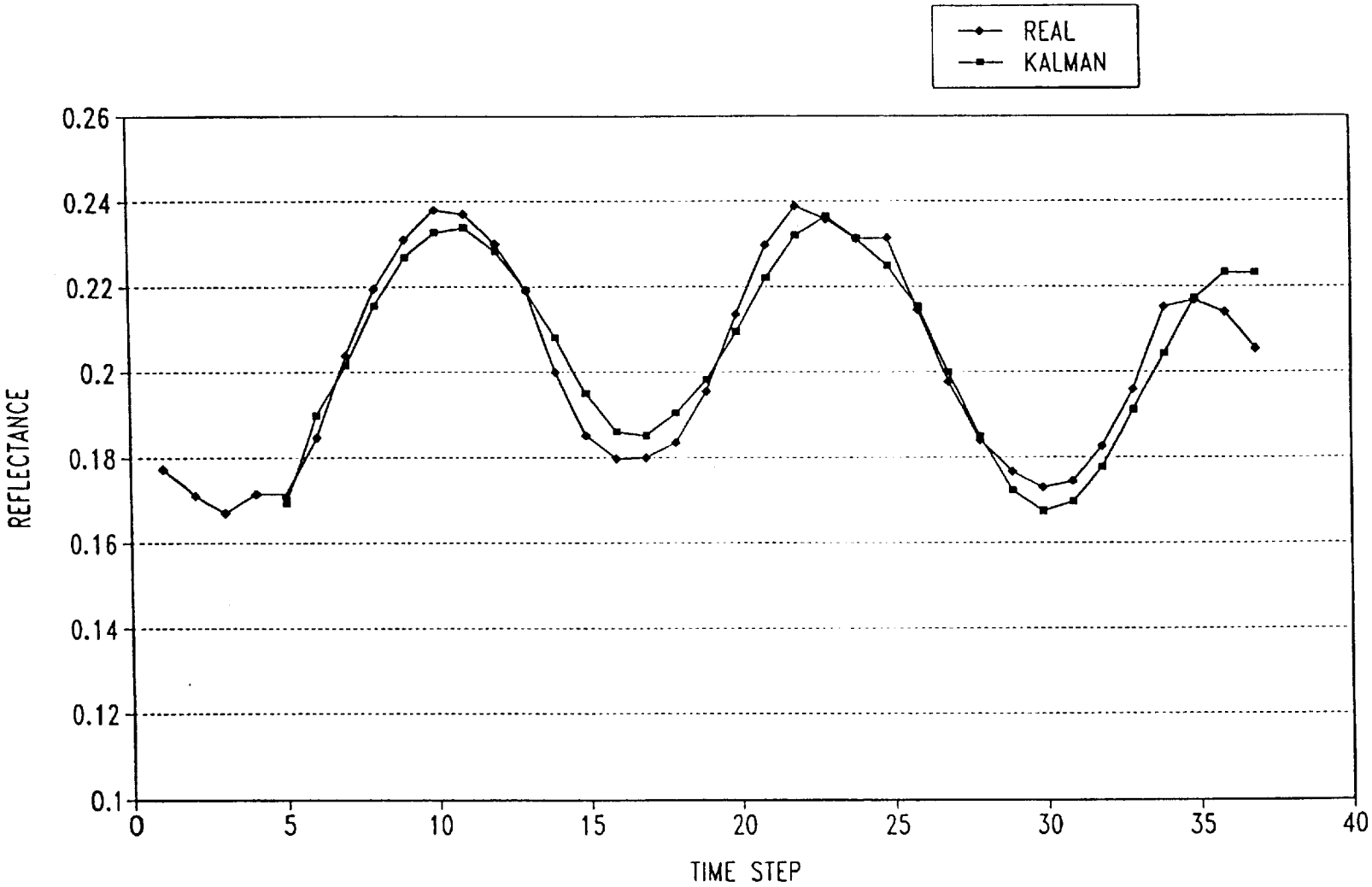
FIG. 7 is a graph illustrating the estimated reflectance and the actual reflectance over a portion of a planarizing cycle.

FIG. 7 is a graph illustrating the actual reflectance and the estimated reflectance based upon estimates of the state variables d, er, h and L using the optical algorithms for r and $$\frac{\partial r}{\partial d}$$

programmed in the computer 210, the optical module 220, and the Kalman module 230. FIG. 7 shows that the estimated reflectance tracks the actual reflectance. The state variables based upon the estimated reflectance are thus approximately equal to the actual values for the state variables during the planarizing cycle. FIG. 7 accordingly indicates that the method 400 accurately estimates the state variables in-situ without interrupting the planarizing cycle.

One advantage of the embodiment of the method illustrated in FIG. 6 is that it is expected to provide accurate estimates of the endpoint of a planarizing cycle. The accuracy of the method 400 is enhanced by providing optical algorithms that model the reflectance based upon both the reflectance from the arrays 312 and the periphery areas 314. Unlike conventional models for reflectance that treat the reflectance from the periphery areas as noise, the method 400 uses the proportionate value of the array reflectance and the proportionate value of the periphery reflectance to provide an accurate algorithm for modeling the estimated reflectance. Several embodiments of the method illustrated in FIG. 6 are expected to provide accurate in-situ and real time estimates of the endpoint for a planarizing cycle.

Several embodiments of the methods in accordance with FIG. 6 are also expected to provide information regarding other aspects of CMP processing. For example, when the estimated reflectance does not converge with the value of the actual reflectance, it is apparent that the planarizing process is not proceeding in an expected manner. In a typical application, for example, the planarizing process may not proceed as expected because the condition of the polishing pad, the effectiveness of the planarizing solution, the downforce exerted by the carrier assembly and other factors may not be within a desired range. Therefore, unexpected variances between the estimated reflectance and the measured reflectance provide a diagnostic tool for indicating that a planarizing parameter is not within an acceptable range.

The method 400 illustrated in FIG. 6 and the planarizing machine 100 illustrated in FIG. 2 set forth several embodiments of determining the endpoint of CMP processing in accordance with the invention. It will be appreciated that the invention is not limited to these embodiments, but the invention also includes other ways of iteratively refining the estimates of the state variables, other combinations of state variables, and other output factors that can be used to measure the performance of the particular planarizing cycle. The output factor, for example, can be the reflectances of a plurality of wavelengths of light or the drag force between the substrate and the polishing pad. Additionally, instead of using an EKF algorithm for refining the estimates of the state variables, it is expected that the state variables can be refined using extrema counting or a least squares fit routine. The EKF algorithm, however, is preferred over other processes for iteratively determining a plurality of state variables using dynamic equations.

Figure 8:
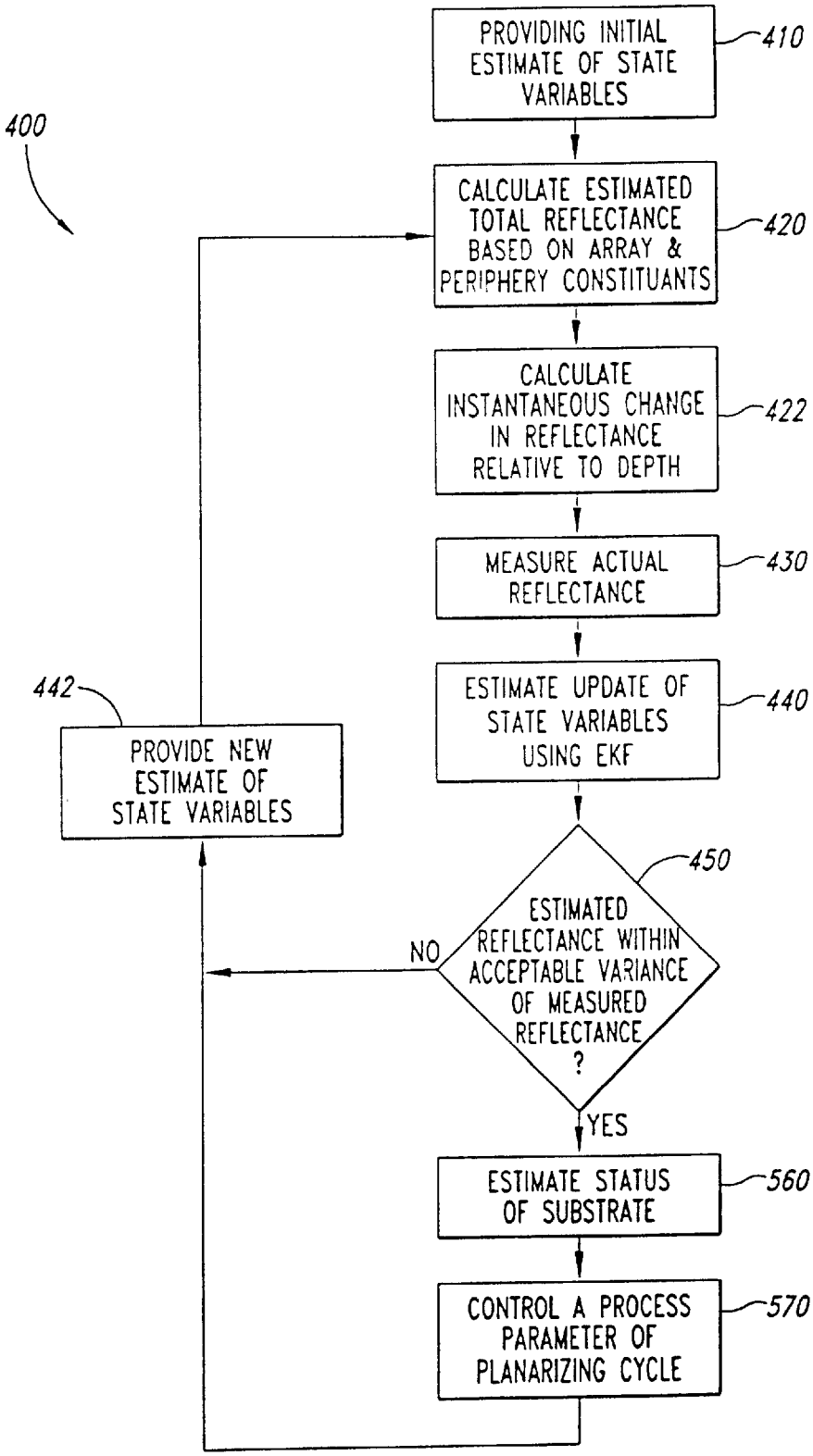
FIG. 8 is a flowchart of another method in accordance with another embodiment of the invention.

FIG. 8 is a flowchart of another method in accordance with another embodiment of the invention. In this embodiment, the method includes the routines 410–450 described above with reference to FIG. 6, a substrate status routine 560, and a control routine 570. The substrate status routine 560 estimates the status of the substrate surface according to the estimated values of the state variables. The substrate status, for example, can be the thickness of the outer film over either the array areas or the periphery areas, the array erosion rate, the periphery erosion rate, or several other of the state variables. The control routine 570 changes or maintains one or more parameters of the planarizing cycle according to the estimated status of the substrate surface.

Figure 9A:
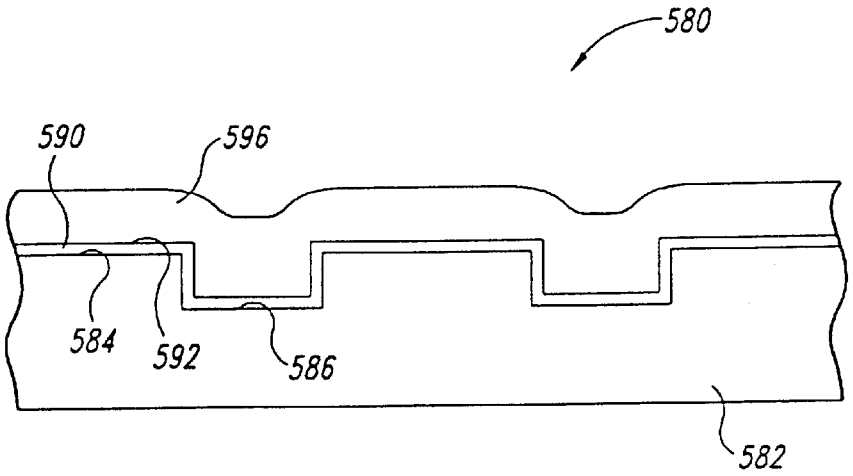
FIGS. 9A–9C are schematic partial cross-sectional views of a shallow-trench-isolation structure at various stages of planarizing a substrate in accordance with an embodiment of a method of the invention.
Figure 9B:
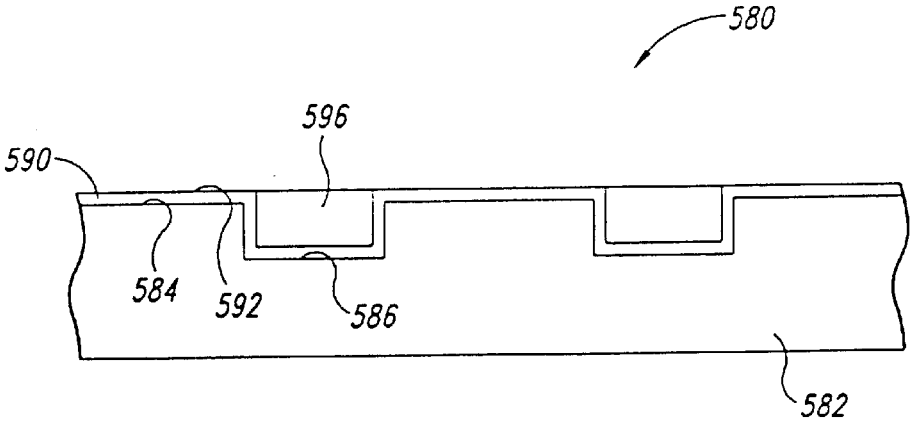
Figure 9C:
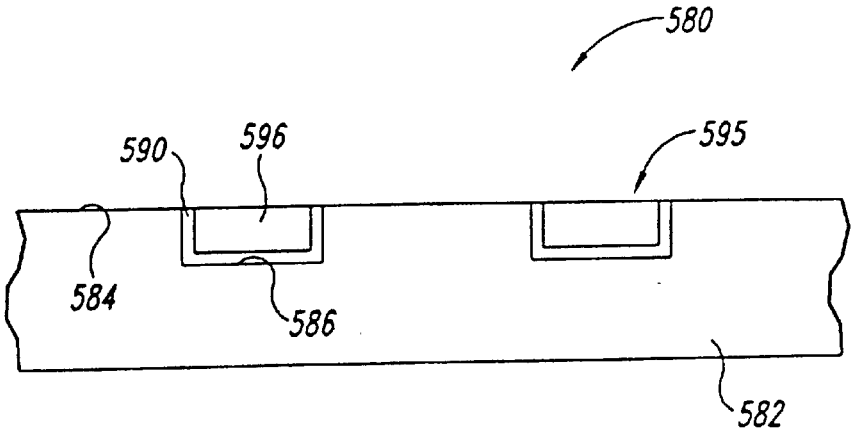

The status routine 560 and the control routine 570 are useful, for example, to predict the endpoint of a planarizing cycle for constructing Shallow-Trench-Isolation (STI) structures on the substrate assembly. FIGS. 9A–9C are schematic partial cross-sectional views of a substrate assembly 580 at various stages of a method for forming STI structures 595 (FIG. 9C). Referring to FIG. 9A, the substrate assembly 580 initially has a substrate 582 with a top surface 584 and a plurality of trenches 586 extending along the top surface 584. The substrate assembly 580 also includes a thin conformal layer 590 (e.g., a silicon nitride layer) that covers the top surface 584 of the substrate 582 and conforms to the trenches 586, and a fill layer 596 (e.g., a silicon dioxide, BPSG or TEOS layer) over the conformal layer 590 that fills the trenches 586.

FIG. 9B illustrates the substrate assembly 580 after it has been planarized to expose the conformal layer 590 over the top surface of the substrate 582. In one embodiment of a method for planarizing the substrate assembly 580, the exposure of the conformal layer 590 over the top surface 584 of the substrate 582 is estimated using the EKF method described above with reference to FIG. 6. But, instead of calculating the endpoint time for the planarizing cycle and comparing the elapsed time with the endpoint time according to the method 400 of FIG. 6, this method calculates the time for removing the fill layer over the top portions of the conformal layer 590. When the elapsed time equals the calculated time of exposure of the conformal layer 590, the control routine 570 of this method then uses another process for determining the final endpoint of the planarizing cycle. FIG. 9C illustrates the final endpoint for the STI structure 595 in which the conformal layer 590 has been removed from the top surface 584 of the substrate 582. In one embodiment, the other process for determining the final endpoint involves periodically measuring the actual thickness of the conformal layer using an interferometer or other technique (e.g., diagnostic machines manufactured by Nova). In another embodiment, the other process for determining the endpoint involves sensing or monitoring the drag force between the substrate assembly 580 and a planarizing medium using the motor current for the planarizing machine or a load cell. Suitable planarizing machines that monitor the drag force are disclosed in U.S. Pat. Nos. 5,036,015 and 5,069,002, and U.S. application Ser. No. 09/386,648, all of which are herein incorporated by reference.

The control routing 570 can also control other aspects of the planarizing cycle. In one embodiment, for example, the control routine 570 can terminate the planarizing cycle if the erosion rate over either the array areas or the periphery areas is not within an acceptable range, or if the predicted thickness is not within an expected range. In still another embodiment, the control routine can change the type or volume of the planarizing solution according to the estimates of the erosion rates or the predicted thickness.

From the foregoing it will be appreciated that, although specific embodiments of the invention have been described herein for purposes of illustration, various modifications may be made without deviating from the spirit and scope of the invention. For example, the EKF algorithm can be based on a direct calculation of the thickness of a layer over the array areas and/or the periphery areas, and/or a calculation of the array erosion rate and the periphery erosion rate. The state variable for the state vector x can also alternatively include: (a) the thickness of a layer over the array areas; (b) the thickness of a layer over the periphery areas; (c) the array erosion rate; (d) the periphery erosion rate; and (e) the sensor gain. Additionally, the terms array areas and periphery areas as used herein mean "high density" areas and "low density" areas, respectively, without being limited to a particular geographic region on the substrate or relative to each other. Accordingly, the invention is not limited except as by the appended claims.

What is claimed is:

1. In chemical-mechanical planarization of microelectronic substrate assemblies, a method for determining the status of a microelectronic substrate during a planarizing cycle comprising:

determining an estimated value of an output factor related to a process parameter that can be measured during the planarizing cycle by modeling the output factor based upon a predicted thickness of a layer on the substrate and an estimated removal rate relationship;

ascertaining an updated predicted thickness of the layer by measuring an actual value of the output factor during the planarizing cycle and calculating an updated thickness according to the actual value of the output factor and the estimated value of the output factor;

repeating the determining procedure and the ascertaining procedure using the updated predicted thickness of the layer of an immediately previous iteration to bring the estimated value of the output factor to within a desired range of the actual value of the output factor; and controlling a process parameter of the planarizing cycle when the updated predicted thickness of the layer is within a desired range of a predetermined elevation for the substrate assembly.

2. The method of claim 1 wherein controlling a parameter of the planarizing cycle comprises terminating removal of material from the substrate when the updated predicted thickness of the layer is within a desired range of an endpoint elevation for the substrate assembly, the endpoint elevation defining the predetermined elevation.

3. The method of claim 1 wherein:

the output factor comprises a total reflectance intensity of a selected wavelength of radiation directed at the substrate through an optical passthrough system during the planarizing cycle;

a first region of the substrate comprises arrays on the substrate and a first thickness of the layer is over the arrays;

a second region comprises periphery areas on the substrate and a second thickness of the layer is over the periphery areas; and determining an estimated value of the output factor comprises-providing a total reflectance algorithm modeling the total reflectance intensity of the selected wavelength of radiation as a function of the first thickness of the layer over the arrays and an erosion rate ratio defining the removal rate relationship based on an array erosion rate and a periphery erosion rate, and calculating an estimate of the total reflectance intensity using the total reflectance algorithm, the estimated erosion rate ratio, the predicted thickness, and the updated predicted thickness of the layer.

4. The method of claim 1 wherein:

the output factor comprises a total reflectance intensity of a selected wavelength of radiation directed at the substrate through an optical passthrough system during the planarizing cycle;

a first region comprises arrays on the substrate and a first thickness of the layer is over the arrays;

a second region comprises periphery areas on the substrate and a second thickness of the layer is over the periphery areas; and determining an estimated value of the output factor comprises providing a total reflectance algorithm modeling the total reflectance intensity of the selected wavelength of radiation as a function of the first thickness of the layer over the arrays and an erosion rate ratio defining the removal rate relationship based on an array erosion rate and a periphery erosion rate according to the equation $$r=v\cdot R_A+(1-v)\cdot R_P,$$

calculating an estimate of the total reflectance intensity using the total reflectance algorithm, the estimated erosion rate ratio, the predicted thickness, and the updated predicted thickness of the layer.

providing a change in reflectance intensity algorithm modeling a change in reflectance intensity relative to an incremental change in thickness of the layer according to the equation $$\partial r/\partial d = \frac{R_{A_d} - [v \cdot R_{A(d-i)} + (1-v)R_{P(d-i)}]}{i}, \text{ and}$$

calculating an estimate of the change in reflectance intensity using the change in reflectance intensity algorithm, the predicted erosion rate ratio, a selected incremental change in thickness of the layer of i, the predicted thickness, and the updated predicted thickness of the layer.

5. The method of claim 4 wherein calculating an estimate of the change in reflectance intensity further comprise selecting an incremental change in thickness of the layer of 5–20 Å.

6. The method of claim 4 wherein calculating an estimate of the change in reflectance intensity further comprises selecting an incremental change in thickness of the layer of 5 Å.

7. The method of claim 1 wherein:

the output factor comprises a total reflectance intensity of a selected wavelength of radiation directed at the substrate through an optical passthrough system during the planarizing cycle;

a first region comprises arrays on the substrate and the first thickness of the layer is over the arrays;

a second region comprises periphery areas on the substrate; and determining an estimated value of the output factor comprises providing a total reflectance algorithm modeling the total reflectance intensity of the selected wavelength of radiation as a function of the first thickness of the layer over the arrays and an erosion rate ratio defining the removal rate relationship based on an array erosion rate and a periphery erosion rate, and calculating an estimate of the total reflectance intensity using the total reflectance algorithm, the estimated erosion rate ratio, the predicted thickness, and the updated predicted thickness of the layer, and revising the prediction of the thickness of the layer comprises selecting a set of state variables including the first thickness of the layer over the arrays (d), the erosion rate (er) over the arrays, the erosion rate ratio (L) between the array erosion rate and the periphery erosion rate, and an optical gain (h) of an optical system for measuring the actual value of the reflectance intensity from the substrate, and calculating the updated predicted thickness of the layer over the first region, and calculating updated values for the erosion rate, the erosion rate ratio and the optical gain using an Extended Kalman Filtering algorithm based on the calculated total reflectance and an actual reflectance measured by the optical system.

8. The method of claim 7 wherein an initial estimate of the predicted thickness of the layer is provided by measuring a thickness of a film over arrays on an identical substrate in a previous planarizing cycle and using the measured thickness as the predicted thickness for a first iteration of the determining and ascertaining procedures.

9. The method of claim 7 wherein an initial estimate of the erosion rate ratio for a first iteration of the determining and ascertaining procedures is provided by determining an array erosion rate of an outer film over an array and a periphery erosion rate of the film over a periphery area of an identical substrate in a previous planarizing cycle and dividing the determined periphery erosion rate by the determined array erosion rate.

10. The method of claim 1 wherein:

the output factor comprises a total reflectance intensity of a selected wavelength of radiation directed at the substrate;

a first region comprises arrays on the substrate and a second region comprises periphery areas on the substrate;

determining an estimated value of the output factor comprises calculating an estimate of the total reflectance intensity using an algorithm associating a proportionate array reflectance from the arrays and a proportionate periphery reflectance from the periphery areas; and ascertaining the updated predicted thickness of the layer comprises processing the predicted thickness, the estimated value of the total reflectance, and an actual total reflectance using an Extended Kalman Filtering algorithm to obtain the updated predicted thickness of the outer film over the first region.

11. The method of claim 10 wherein:

the substrate has a top surface, a shallow trench along the top surface, a thin conformal layer covering the top surface and conforming to the trench, and a fill layer defining an outer layer;

controlling a process parameter comprises estimating an elapsed time corresponding to exposure of the conformal layer over the top surface of the substrate when the updated predicted thickness of the outer layer indicates that the fill layer has been removed from the thin conformal layer over the top surface of the substrate;

approximating when the thin conformal layer has been removed from the top surface of the substrate by measuring the actual thickness of the thin conformal layer over the top surface of the substrate; and terminating removal of material from the substrate when the thin conformal layer over the top surface of the substrate has been removed.

12. The method of claim 10 wherein:

the substrate has a top surface, a shallow trench along the top surface, a thin conformal layer covering the top surface and conforming to the trench, and a fill layer defining the outer layer on the thin conformal layer that fills the trench;

controlling a process parameter comprises estimating an elapsed time corresponding to exposure of the conformal layer over the top surface of the substrate when the updated predicted thickness of the outer layer indicates that the fill layer has been removed from the thin conformal layer over the top surface of the substrate;

approximating when the thin conformal layer has been removed from the top surface of the substrate by a change in drag force between the substrate and a planarizing medium; and terminating removal of material from the substrate when the change in drag force indicates that the thin conformal layer over the top surface of the substrate has been removed.

13. The method of claim 1 wherein controlling a process parameter comprises terminating the planarizing cycle if the erosion rate is not within a prescribed range.

14. The method of claim 1 wherein controlling a process parameter comprises changing a planarizing solution type if the erosion rate is not within a prescribed range.

15. The method of claim 1 wherein controlling a process parameter comprises terminating the planarizing cycle if the thickness of the layer is not within a prescribed range.

* * * * *

UNITED STATES PATENT AND TRADEMARK OFFICE

CERTIFICATE OF CORRECTION

PATENT NO. : 6,547,640 B2
DATED : April 15, 2003
INVENTOR(S) : Jim Hofmann

It is certified that error appears in the above-identified patent and that said Letters Patent is hereby corrected as shown below:

Column 2,
Line 11, "applications;" should be -- applications. --;
Line 47, delete "a" between "to" and maximize";
Line 54, delete "an" after "components";

Column 8,
Line 63, should be -- $h((k+1)T)=h(kT)+w_h(kT)$ --;

Column 13,
Line 37, "*Filler*" should be -- *Filter* --;

Column 17,
Line 37, "layer." should be -- layer, --;

Column 18,
Line 39, "an outer film" should be -- a film --;
Line 62, "outer film" should be -- layer --;

Column 19,
Line 1, insert hyphen after "comprises";
Line 19, delete "the" between "defining" and "outer";
Line 21, insert hyphen after "comprises";

Column 20,
Line 6, insert -- monitoring -- between "by" and "a";

Signed and Sealed this

Ninth Day of September, 2003

JAMES E. ROGAN
*Director of the United States Patent and Trademark Office*